US006354643B1

(12) United States Patent
Podejko

(10) Patent No.: US 6,354,643 B1
(45) Date of Patent: Mar. 12, 2002

(54) TENNIS BALL HOLDER AND RETRIEVER

(76) Inventor: Mariusz Podejko, 921 Casey Ct. - Unit #6, Schaumburg, IL (US) 60173

( * ) Notice: Subject to any disclaimer, the term of this patent is extended or adjusted under 35 U.S.C. 154(b) by 0 days.

(21) Appl. No.: 09/440,845

(22) Filed: Nov. 16, 1999

(51) Int. Cl.[7] ..... A63B 47/02
(52) U.S. Cl. ..... 294/19.2; 280/47.34
(58) Field of Search ..... 294/19.2; 56/327.1, 56/328.1; 206/315.9; 248/129, 132; 280/43, 47.26, 47.34, 47.315, 47.36, 47.371, 47.41, 651, 685; 414/437–440; 473/460

(56) References Cited

U.S. PATENT DOCUMENTS 3,168,271 A * 2/1965 Deschenes ..... 248/129
4,461,504 A * 7/1984 Perez et al. ..... 294/19.2
4,844,527 A * 7/1989 Ray ..... 294/19.2
5,046,748 A * 9/1991 Oat-Judge ..... 280/47.34
5,301,991 A * 4/1994 Chen et al. ..... 294/19.2
5,464,262 A * 11/1995 Madrazo ..... 294/19.2
5,507,541 A * 4/1996 Chen et al. ..... 294/19.2
6,142,544 A * 11/2000 Benzoni et al. ..... 294/19.2

* cited by examiner

*Primary Examiner*—Johnny D. Cherry
(74) *Attorney, Agent, or Firm*—Dillis V. Allen, Esq.

(57) ABSTRACT

A tennis ball holder and retriever easily movable about the court with four swivel caster assemblies at its corners. The holder and retriever include a wireform basket-like structure with a bottom wall designed to pick up tennis balls when pushed down over the balls. The swivel caster assemblies have small diameter wheels and are mounted to the corners of the basket-like structure with downwardly spring-biased telescopic tubular assemblies that position the basket above the balls for rolling movement about the court yet permit the basket-like structure to be depressed to its ball pick-up position.

16 Claims, 3 Drawing Sheets

TENNIS BALL HOLDER AND RETRIEVER

BACKGROUND OF THE INVENTION

There are presently a plurality of different types of ball retrieving wireform baskets used in the tennis court environment for holding dozens of balls, utilized by tennis instructors, or just players, to assist in rapid fire training exercises. These basket-like structures include a generally rectangular wireform basket with pivotal handles that can be positioned over the basket to carry the basket about the court or to a second position depending downwardly to support the basket spaced above the court that permit the instructor to pick balls out of the basket and hit them to the student or the player practicing on the other side of the net.

The bottom walls of these baskets, at least in one specific type, include a plurality of generally horizontal parallel wires that are spaced from one another less than the diameter of the ball that when pushed downwardly over the tennis balls, squeeze the balls and permit them to enter into the basket yet prevents them from falling out of the basket.

While these ball pick-up baskets have had a considerable commercial success, they are difficult to use because they become quite heavy when loaded with balls and cause significant fatigue after many hours of daily training common to tennis instructors. The instructors' energies are better utilized in the actual training exercises rather than in walking around the court carrying this basket and picking up literally dozens of tennis balls.

A patentability search pertaining to the present invention had been previously conducted and yielded the following patents:

| Inventor | U.S. Pat. No. | Issue Date |
|---|---|---|
| Ferrier | 2,744,765 | May 8, 1956 |
| Campbell | 3,889,996 | June 17, 1975 |
| Jackle, et al. | 3,904,200 | Sept. 9, 1975 |
| McCrea | 4,236,693 | Dec. 2, 1980 |
| Perez, et al. | 4,461,504 | July 24, 1984 |
| Kaiser, II | 5,306,029 | April 26, 1994 |

FOREIGN PATENTS

Derwent Publications, Ltd.

German, DE 4020-991-A

The Perez, et al., U.S. Pat. No. 4,461,504 discloses a tennis ball retriever and carrier with a plurality of wheels 30, 32, 34, and 36 that support the carrier above the ground less than ½ the radius of the tennis ball. In order to capture the tennis balls off the court's surface, the user has to tip the container backwards on one set of wheels and then tilt the container back down on top of the balls. This creates the possibility of the balls squirting forwardly out from under the tilted container.

The German Derwent Publications, Ltd., DE 4020-991-A, shows a tennis ball collector and pick up device similar to the Perez, et al. on a frame with wheels.

The Ferrier, U.S. Pat. No. 2,744,765; the McCrea, U.S. Pat. No. 4,236,693; and the Kaiser, II, U.S. Pat. No. 5,306,029, all show spring-biased wheels on devices that are non-analogous to tennis ball pick-up devices.

The Jackle, et al., U.S. Pat. No. 3,904,200, shows a device for implanting a tee ball in the earth.

The Campbell, U.S. Pat. No. 3,889,996, shows a wheelless tennis ball retriever that has vertically movable and spring-biased pick-up bars.

It is a primary object of the present invention to provide a tennis ball holder and retriever that ameliorates the problems noted above.

SUMMARY OF THE PRESENT INVENTION

According to the present invention, a tennis ball holder and retriever is provided that is easily movable about the tennis court and thereby reduces training and instructor fatigue. This is accomplished with the provision of four swivel caster assemblies at the corners of a generally rectangular wireform basket-like structure.

The bottom wall of the basket-like structure is designed to pick up tennis balls when pushed downwardly on the balls. The swivel caster assemblies have small diameter wheels that are mounted at the corners of the basket-like structure. The small diameter wheels permit the wheels and their associated assemblies to be mounted very closely to the basket-like structure and provide a much more compact design.

The swivel caster assemblies each include downwardly biased telescopic tubular assemblies that are fixed to the corners of the basket-like assembly that position the basket above the balls for rolling movement about the court yet permit the basket-like structure to be depressed to its ball pick up position.

The telescopic tubular assemblies each include an upper tubular portion fixed to the basket-like structure with a wireform bracket that has a circular portion surrounding and fixed to the upper tubular portion and a pair of leg portions that are generally perpendicular and fixed to the basket-like structure. The telescopic tubular assemblies also include a lower tubular rod portion slidable in the upper tubular portion that has a pin fixed thereto that slides in a slot in the upper tubular portion limiting downward movement of the lower rod portion from the upper tubular portion.

Other objects and advantages of the present invention will appear more clearly from the following detailed description.

DETAILED DESCRIPTION OF THE PREFERRED EMBODIMENTS

Figure 1:
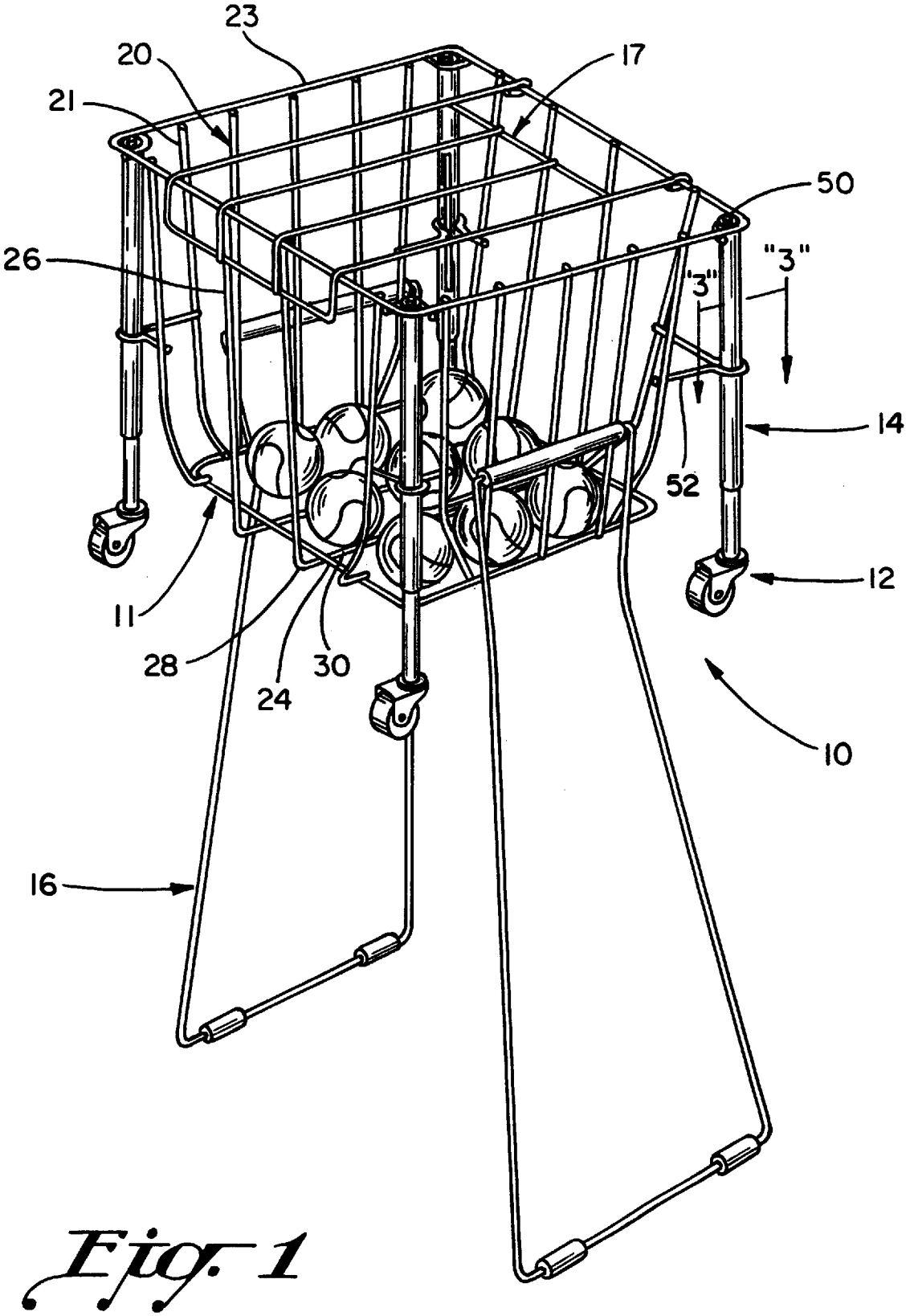
FIG. 1 is a perspective view of the present tennis ball holder and retriever supported by its handles above the court surface.
Figure 5:
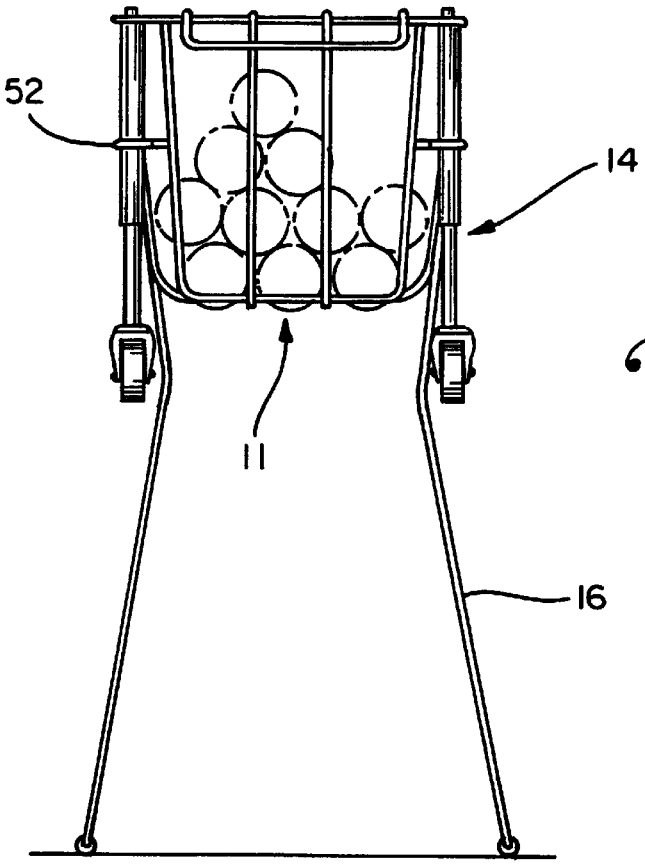
FIG. 5 is a side view of the tennis ball holder and retriever pictured in perspective view of FIG. 1.

Referring to the drawings and at first generally FIG. 1, the present tennis ball holder and retriever 10 is seen to generally include a generally rectangular wireform basket-like structure 11, four telescopically mounted swivel caster assemblies 12, which are supported at the four corners of the basket-like structures with downwardly spring-biased telescopic assemblies 14, and pivotally mounted wireform handles 16 that permit the basket-like structure 11 to be positioned in a first position illustrated in FIGS. 1 and 5, for holding the balls in a convenient elevated position for the instructor to take balls out of the basket and hit them over the net to the student, and a second position with the wheels engaging the ground. Also included is a pivotal wireform cover 17 that is optional and prevents the balls from falling out of the basket if the basket falls over.

The wireform basket consists of four side walls such as at 20 including a plurality of spaced generally parallel vertical rods 21 that are welded at their upper ends to a generally rectangular upper wireform 23 and at their lower ends to a generally rectangular lower wireform 24. The vertical rods 26 forming the adjacent side walls are bent approximately 90 degrees at their lower ends 28, and they form spaced parallel rods 30 that define the bottom wall of the basket.

Figure 6:
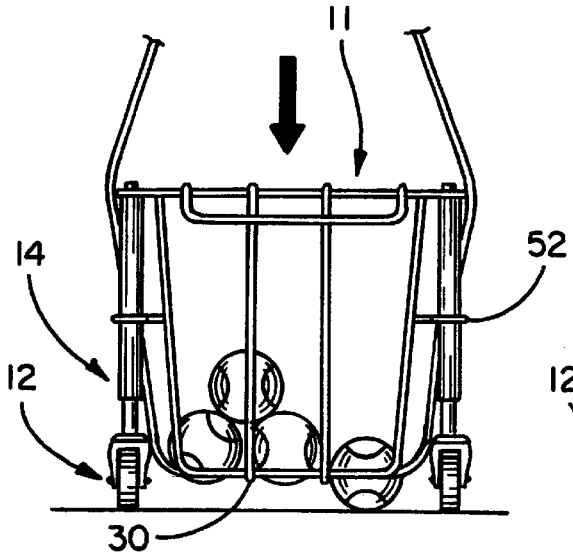
FIG. 6 is a fragmented side view of the present tennis ball holder and retriever as it is being pushed downwardly over the tennis balls.
Figure 7:
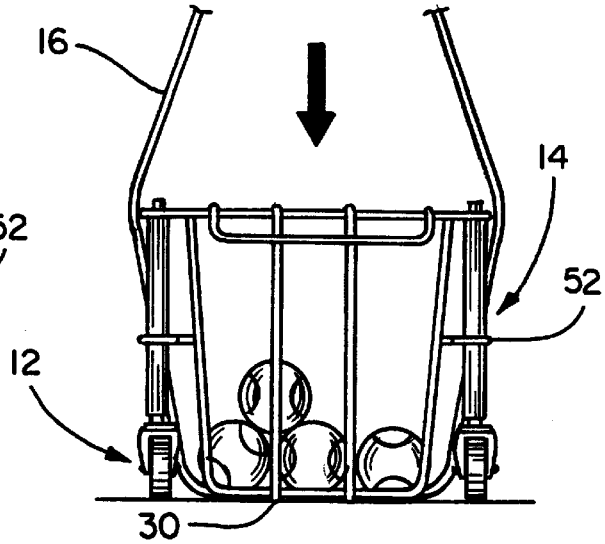
FIG. 7 is a view similar to FIG. 6 but with the bottom of the basket engaging the ground surface after tennis ball pick up has been completed.

As seen in FIGS. 6 and 7, the spaced parallel rods 30 that form the bottom wall are spaced apart less than the diameter of the ball so that as the basket is moved from its FIG. 6 position to its FIG. 7 position, the rods 36 squeeze the ball and pop the ball into the interior of the basket.

Figure 4:
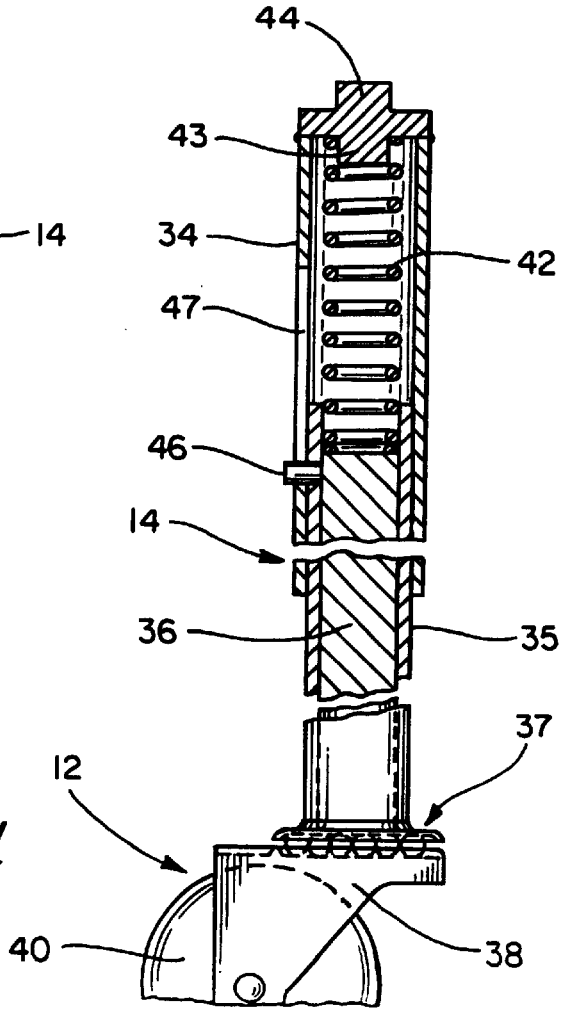
FIG. 4 is a fragmented longitudinal section through one of the wheel assemblies.

As seen in FIG. 4, where one of the caster assemblies 12 and its connected telescopic assembly 14 are depicted, the telescopic assembly 14 is seen to include an upper tubular portion 34 fixed to the corners of the basket 11 and a lower tubular portion 35 telescopically slidable in the upper tubular portion 34. The swivel caster assembly 12 includes a solid pintle 36 fixed inside lower tubular portion 35, and a swivel bearing assembly 37 that permits swiveling motion of a standard horn member 38 about a generally vertical axis. Horn member 38 has downwardly depending flanges that rotationally carry caster wheel 40.

Figure 2:
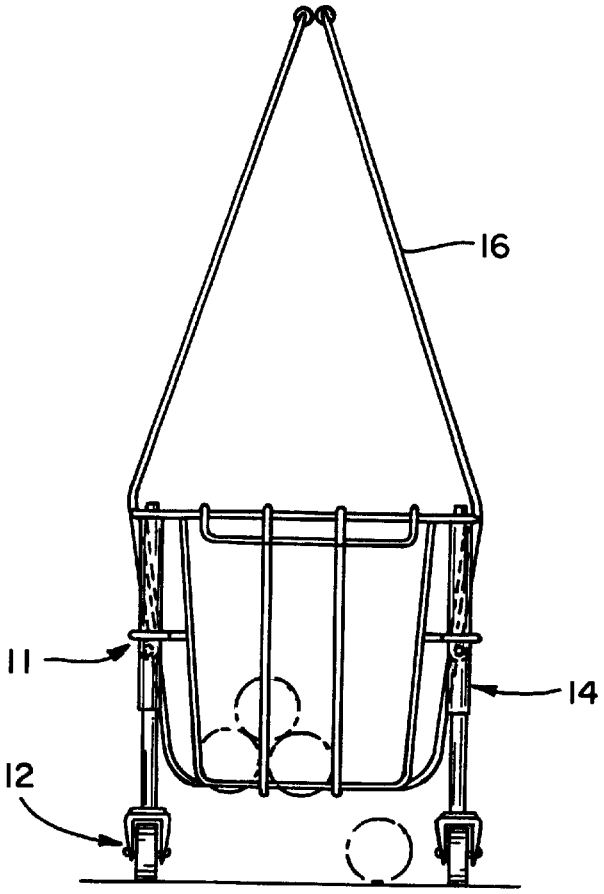
FIG. 2 is a side view of the present tennis ball holder and retriever in its ground-engaging mode with the handles pivoted upwardly in their handle position and with the bottom wall of the basket-like structure spaced above tennis balls lying on the court's surface.

The diameter of the caster wheel 40 is substantially less, as seen in FIG. 2, than the spacing of the basket bottom wall from the ground in its rolling movement position. This enables the caster assemblies and the telescopic assemblies 14 to be mounted more closely to the basket because larger diameter wheels will interfere with the movement of the basket from its FIG. 6 position to its FIG. 7 position and thus require the larger diameter wheel assemblies to be mounted further outwardly from the basket 11 providing a much larger assembly.

A coil compression spring 42 is mounted within the upper tubular section 34 and is seated on a cylindrical spring seat 43 formed on a top plug 44 fixed to and enclosing the top of the upper tubular portion 34. The lower end of the spring 42 is seated within the upper end of the lower rod portion 35 and engages the top of the pintle 36 urging the pintle and the rod portion 35 downwardly in upper tubular portion 34.

The tubular portion 35 has a short pin 46 fixed therein and extending radially outwardly therefrom through a vertical slot 47 in the side of upper tubular portion 34. Pin 46 engages the bottom of slot 47 to limit the downward movement of the tubular portion 35. This position illustrated in FIG. 4 is the same position illustrated in FIG. 2 that positions the basket-like structure 11 for rolling motion around the court.

The upper end of the upper tubular portion 34 is welded, as seen in FIG. 1, at 50 to the corners of the upper wireform 23.

Figure 3:
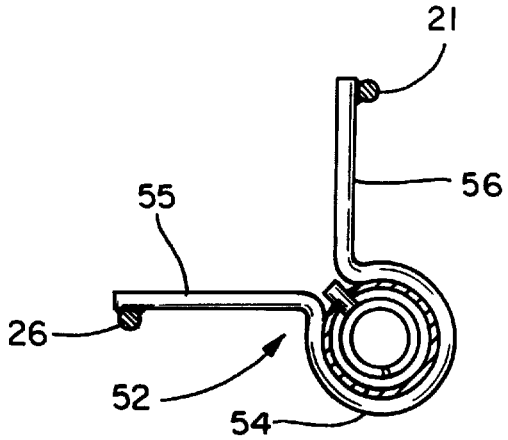
FIG. 3 is a fragmentary section taken generally along line 3—3 of FIG. 1 showing the wireform brackets for holding the wheel assemblies to the basket-like structure.

Brackets 52 also assist in supporting the telescopic assemblies and the swivel casters 12 to the basket-like structure 11. The brackets 52 are illustrated in FIG. 3 and are seen to be a wireform having a circular portion 54 welded about midpoint to the upper tubular portion 34 with a pair of generally perpendicular leg portions 55 and 56 having their ends welded to the vertical rods 26 and 21 at the corners of the basket.

The length of the slots 47 is selected so that as the basket is depressed, the pin 46 slides upwardly in slot 47 but does not engage the upper end of the slot when the basket-like structure 11 is in the FIG. 7 position.

It should be understood that the present invention can be exemplified in other embodiments and that the basket-like structure 11 is not necessarily a wireform and that the details of the ball pick up mechanism could be modified, for example, by having a planar bottom wall with circular holes that effect the same function.

What is claimed is:

1. A tennis ball holder and retriever, comprising: a generally basket-like structure having a bottom wall with a plurality of openings therein sized to permit entry of tennis balls into the basket as the basket is moved from a first position over a ball supported on a generally horizontal surface to a second position at least below a horizontal diametral plane of the ball, and a plurality of wheel assemblies supporting the basket-like structure for rolling movement on the generally horizontal surface, said wheel assemblies constructed to normally urge the basket-like structure to the first position and permitting movement of the structure to the second position.

2. A tennis ball holder and retriever as defined in claim 1, wherein the wheel assemblies include swivel casters.

3. A tennis ball holder and retriever as defined in claim 1, wherein the wheel assemblies include wheels having a diameter substantially lower than the bottom wall of the basket-like structure in the first position.

4. A tennis ball holder and retriever as defined in claim 1, wherein the basket-like structure is a wireform having side walls including a plurality of generally vertical rods, said bottom wall including a plurality of generally parallel, generally horizontal rods, said bottom wall rods being spaced apart less than the diameter of a standard tennis ball.

5. A tennis ball holder and retriever as defined in claim 1, wherein the wheel assemblies each include an upper fixed tubular portion and a lower rod portion slidable in the upper tubular portion, spring means biasing the lower rod portion downwardly from the upper tubular portion, and a stop limiting downward movement of the lower rod portion from the upper tubular portion.

6. A tennis ball holder and retriever as defined in claim 5, including a wireform for fixing the upper tubular portion to the basket-like structure including a generally circular portion surrounding and fixed to the upper tubular portion and generally perpendicular, generally horizontal arm portions fixed at one end to the circular portion and fixed at the other end to the basket-like structure.

7. A tennis ball holder and retriever as defined in claim 6, wherein the basket-like structure has an upper generally horizontal rod connecting the upper ends of rods comprising the side walls, the upper end of the upper tubular portion also being connected to the upper generally horizontal rod.

8. A tennis ball holder and retriever as defined in claim 5, wherein the upper tubular portion has a slot therein, said stop including a pin fixed to the lower rod portion and slidable in said tubular portion slot.

9. A tennis ball holder and retriever as defined in claim 1, including a pair of handles pivotally mounted on the basket-like structure pivotal from a first position supporting the basket-like structure in an elevated position to a second position above the basket-like structure for wheeling the basket-like structure about the generally horizontal surface.

10. A tennis ball holder and retriever, comprising: a generally basket-like structure having a bottom wall with a plurality of openings therein sized to permit entry of tennis balls into the basket as the basket is moved from a first position over a ball supported on a generally horizontal surface to a second position permitting entry of the balls into the basket-like structure, and a plurality of wheel assemblies supporting the basket-like structure for rolling movement on the generally horizontal surface, said wheel assemblies constructed to normally urge the basket-like structure to the first position and permitting movement of the structure to the second position.

11. A tennis ball holder and retriever, comprising: a generally basket-like structure having a bottom wall with a plurality of openings therein sized to permit entry of tennis balls into the basket as the basket is moved from a first position over a ball supported on a generally horizontal surface to a second position permitting entry of the balls into the basket-like structure, a plurality of wheel assemblies supporting the basket-like structure for rolling movement on the generally horizontal surface, said wheel assemblies constructed to normally urge the basket-like structure to the first position and permitting movement of the structure to the second position, the wheel assemblies each including an upper fixed tubular portion and a lower rod portion slidable in the upper tubular portion, spring means biasing the lower rod portion downwardly from the upper tubular portion, and a stop limiting downward movement of the lower rod portion from the upper tubular portion, the wheel assemblies include swivel casters, and the wheel assemblies including wheels having a diameter sub-stantially lower than the bottom wall of the basket-like structure in the first position.

12. A tennis ball holder and retriever as defined in claim 11, wherein the basket-like structure is a wireform having side walls including a plurality of generally vertical rods, said bottom wall including a plurality of generally parallel, generally horizontal rods, said bottom wall rods being spaced apart less than the diameter of a standard tennis ball.

13. A tennis ball holder and retriever as defined in claim 11, including a wireform for fixing the upper tubular portion to the basket-like structure including a generally circular portion surrounding and fixed to the upper tubular portion and generally perpendicular, generally horizontal arm portions fixed at one end to the circular portion and fixed at the other end to the basket-like structure.

14. A tennis ball holder and retriever as defined in claim 13, wherein the basket-like structure has an upper generally horizontal rod connecting the upper ends of rods comprising the side walls, the upper end of the upper tubular portion also being connected to the upper generally horizontal rod.

15. A tennis ball holder and retriever as defined in claim 11, wherein the upper tubular portion has a slot therein, said stop including a pin fixed to the lower rod portion and slidable in said tubular portion slot.

16. A tennis ball holder and retriever as defined in claim 11, including a pair of handles pivotally mounted on the basket-like structure pivotal from a first position supporting the basket-like structure in an elevated position to a second position above the basket-like structure for wheeling the basket-like structure about the generally horizontal surface.

* * * * *